US005145085A

United States Patent [19]

Yost

[11] Patent Number: 5,145,085

[45] Date of Patent: Sep. 8, 1992

[54] INITIALLY SEALED RECLOSABLE CONTAINER CLOSURE

[75] Inventor: Charles E. Yost, Menomonie, Wis.

[73] Assignee: University of Wisconsin, Menomonie, Wis.

[21] Appl. No.: 827,323

[22] Filed: Jan. 29, 1992

[51] Int. Cl.[5] ..... B65D 41/32

[52] U.S. Cl. ..... 220/269; 220/276; 220/339

[58] Field of Search ..... 220/269, 270, 276, 359

[56] References Cited

U.S. PATENT DOCUMENTS

| | | | |
|---|---|---|---|
| 2,069,380 | 2/1937 | Moore | 215/250 X |
| 2,765,094 | 10/1956 | Ruan | 220/338 |
| 3,494,500 | 2/1970 | Foster | 220/269 |
| 3,773,232 | 11/1973 | Hidding | 222/480 |
| 3,845,872 | 11/1974 | Towns et al. | 222/541 X |
| 3,966,080 | 6/1976 | Bittel | 220/269 |
| 3,998,354 | 12/1976 | Song | 220/269 |
| 4,223,814 | 9/1980 | Sneider | 222/565 |
| 4,371,095 | 2/1983 | Montgomery et al. | 222/153 |
| 4,724,977 | 2/1988 | Cleevely et al. | 220/258 |
| 4,724,978 | 2/1988 | Cleevely et al. | 220/258 |
| 4,739,900 | 4/1988 | Borst | 220/339 |
| 4,969,574 | 11/1990 | Shastal | 220/269 |
| 4,986,465 | 1/1991 | Jacobsson et al. | 229/123.3 |
| 5,020,686 | 6/1991 | Dutt | 220/276 |
| 5,027,999 | 7/1991 | Kucherer | 229/125.08 |
| 5,085,339 | 2/1992 | Roth et al. | 220/269 |

*Primary Examiner*—Stephen Marcus
*Assistant Examiner*—Nova Stucker
*Attorney, Agent, or Firm*—Cushman, Darby & Cushman

[57] ABSTRACT

A container closure is provided for initially hermetically sealing a container and for thereafter reclosing the container. The closure includes a top wall with a hinged flap portion and a locking segment for engaging and retaining the flap when it is depressed downwardly to reclose the container. A portion of the peripheral edge of the flap is initially defined by a frangible seal. Once the frangible seal has been ruptured, the flap can be pivoted about its hinge to open the container and provide access to its contents. Between uses, the flap is depressed downwardly past a flange which projects from the locking wall. The flange holds the flap closed until a positive opening force is applied to the flap.

19 Claims, 3 Drawing Sheets

INITIALLY SEALED RECLOSABLE CONTAINER CLOSURE

BACKGROUND OF THE INVENTION

1. Field of the Invention

The present invention relates to the field of packaging and containers and, in particular, to a container closure for initially hermetically sealing a container which, after initial opening, can be repeatedly reclosed and reopened.

2. Description of the Related Art

A number of containers have been developed wherein a flap may be repositioned to its original position to reclose the container.

For example, U.S. Pat. No. 3,773,232, shows a cover fitting for a container including a pair of triangular flaps which are bendable along a pair of respective hinges. The cover also includes a snap type locking mechanism which holds the flap in a raised position.

U.S. Pat. Nos. 3,845,872 to Towns et al, 4,223,814 to Sneider and 4,371,095 to Montgomery et al all relate to end closures for containers that are opened by applying pressure to one portion of an end wall. In U.S. Pat. No. 3,845,872, a bead on the free end of a tab engages a mating groove and a ledge to allow the container to be opened and closed. In U.S. Pat. No. 4,232,814, a flap pivots about hinge to open and close the cover. In U.S. Pat. No. 4,371,095, the cap of a container is opened by applying pressure at a point and thereafter lifting an opposite edge.

In U.S. Pat. No. 4,739,900 to Borst, a lid is pivoted about a hinge line to open and close a dispenser. To open the cover, pressure is applied to a particular portion causing a lug to move away and thus allow the lid to open to its preferred biased position.

U.S. Pat. No. 2,069,380 to Moore shows a paper or fiber container that has an opening tab formed by partially cutting through portions of the fiber wall and the upper surface to form a groove. To open the container, pressure is applied to a button. A sharp shoulder acts as a cutting edge and a section is forced into the container. A tab is then pulled outwardly, shearing the foil along the straight edges thereof. To close the container, the tab is returned to substantially its original position.

A problem common to each of the above-identified container closures is that the container can not be initially hermetically sealed and held closed in a way that will be tamper evident, while allowing reclosure of the container, after it is initially opened.

SUMMARY OF THE INVENTION

It is an object of the present invention to provide a container closure that is initially hermetically sealed in a manner to show evidence of tamper.

It is a further object to form the top and side wall of the container closure so that they are integrally joined by a frangible membrane and can be reengaged to close the container after the membrane has been ruptured.

The foregoing and other objects of the invention are realized by providing a closure having a top wall formed as two portions separated by a hinge. The hinge can be a single groove type living hinge or a double groove type living hinge. The flap portion of the top wall includes a gripping tab formed on the exterior side of the top wall. The top and side wall of the closure are integrally joined, at least in part with a frangible membrane. A flange element is defined below the frangible membrane within the closed container.

To open the container closure, a pulling force is applied to the gripping tab. The frangible membrane is broken or torn when the pulling force is sufficiently great. After the container is opened, a peripheral edge of the flap is defined. After the container closure has been initially opened, the flap can be opened and closed by snapping the peripheral edge thereof past the flange element. A stop rim is preferably formed below the flange element within the closed container. The stop rim limits the downward movement of the flap when the container closure is being closed.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
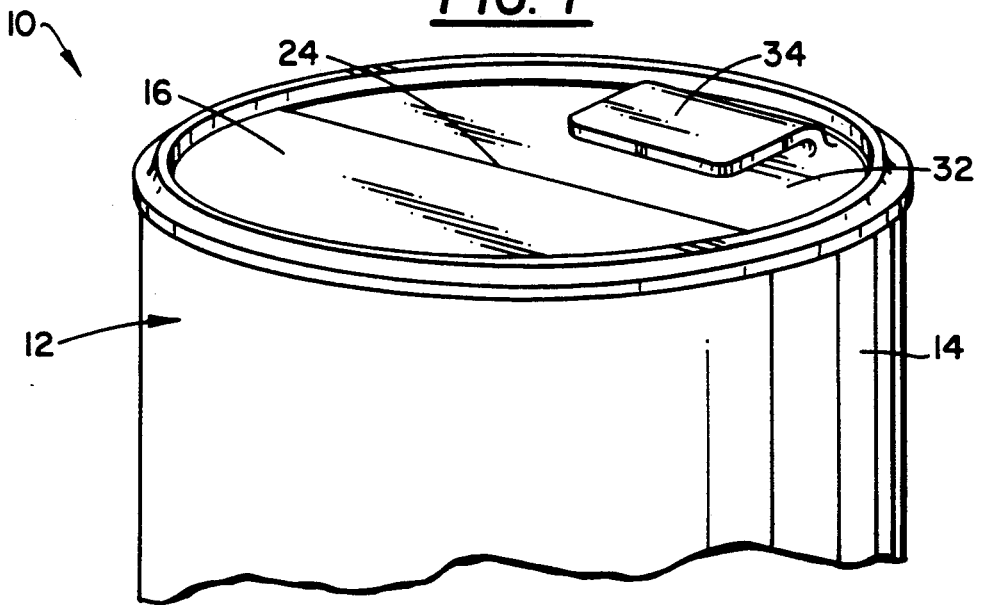
FIG. 1 is a front elevation view of a container with a closure device in accordance with the present invention closing the same.
Figure 2:
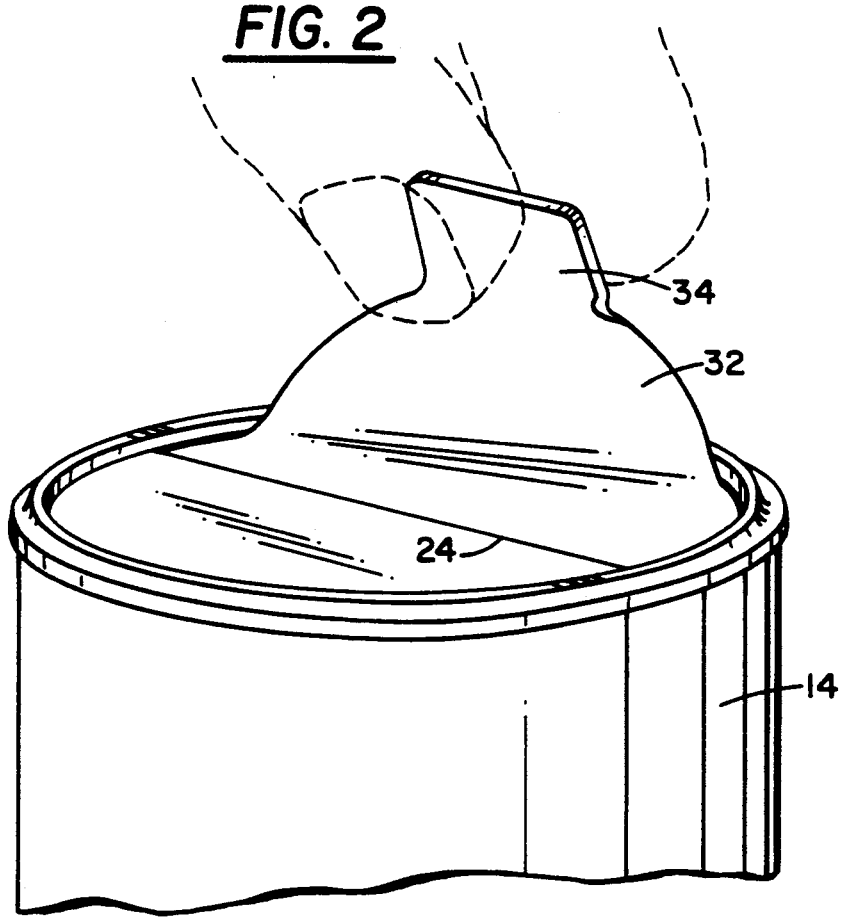
FIG. 2 is a front elevation view of a container with the closure device as it is initially being opened in accordance with the present invention.
Figure 3:
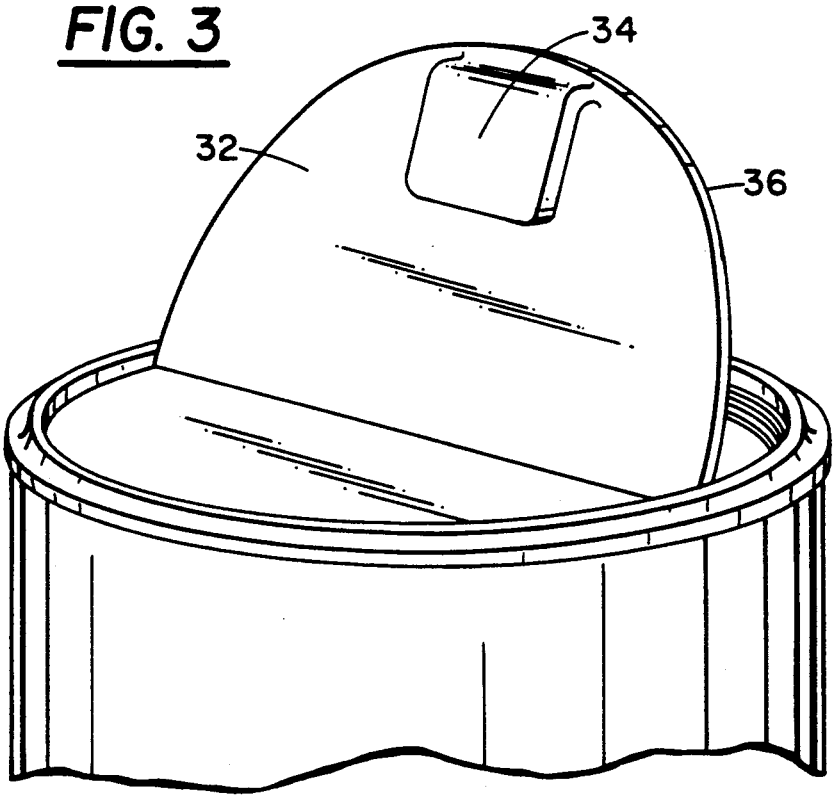
FIG. 3 is a front elevation of an open closure device on a container, in accordance with the present invention.
Figure 4:
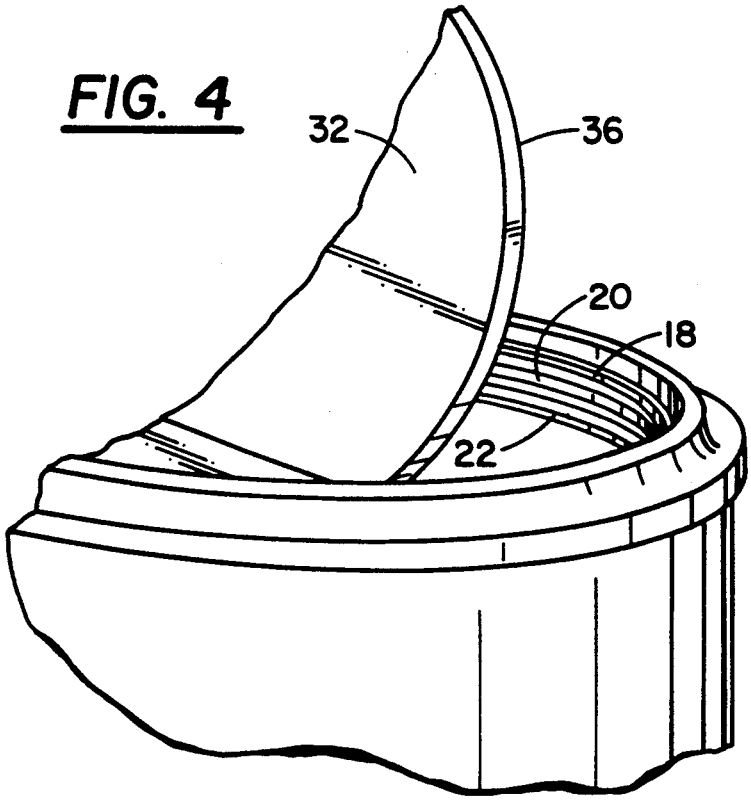
FIG. 4 is an enlarged view of a portion of FIG. 3, showing the seal, flange element and the stop rim.
Figure 5:
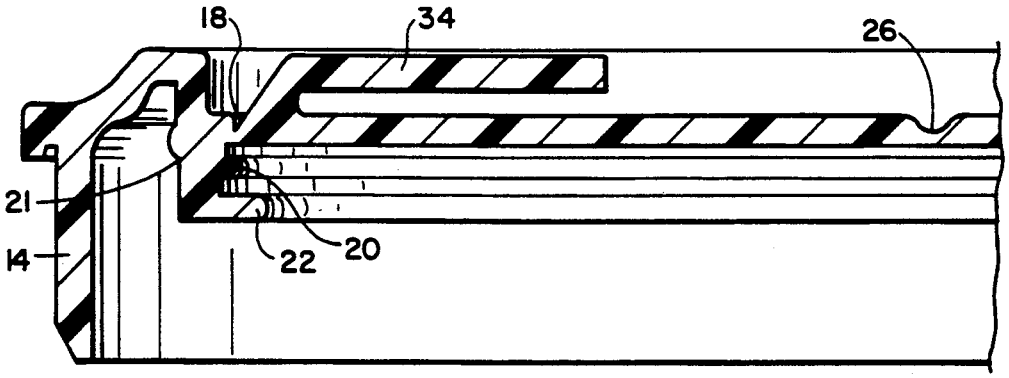
FIG. 5 is a side view of the top wall and side wall of the closure device in the initial sealed position in accordance with a preferred embodiment of the present invention.
Figure 7:
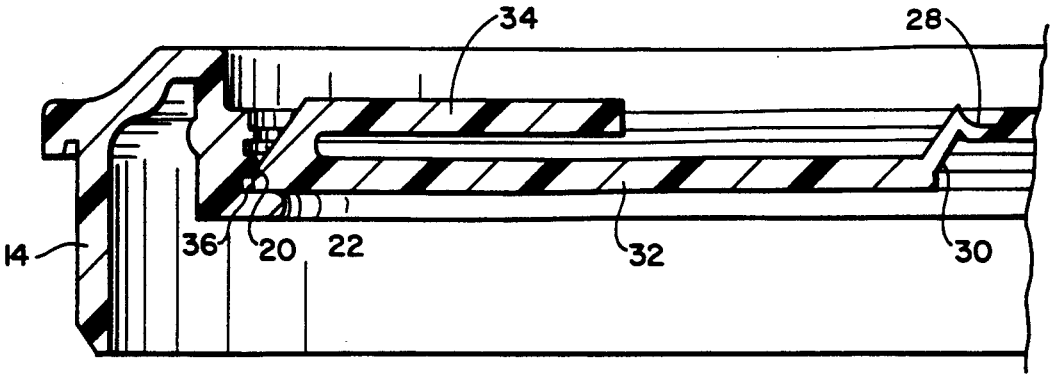
FIG. 7 is a side view of the top wall and side wall of the closure device in the reclosed position with the hinge of FIG. 6.

The container closure 10 in accordance with the present invention can best be seen in FIGS. 5 and 7. The closure is integrally formed with or mounted to a container 12 (FIGS. 1–3) and essentially includes a top wall portion 16, which is at least partially planer, and a downwardly depending locking wall portion or segment 21.

A portion of top wall 16 is defined as a flap 32 which is interconnected with the remainder of the closure via a straight, living hinge 24 and a frangible membrane 18. In the illustrated embodiment, living hinge 24 divides the top wall in two and the frangible membrane 18 is arcuate so that flap 32 is semi-circular. A gripping tab 34 is integrally formed with or mounted to the flap portion 32 to facilitate opening and closure of the assembly, as noted more particularly below.

Locking segment 21 depends downwardly from the top wall 16 of the closure 10 along at least a portion of the length of the frangible seal 18, on the opposite side thereof from flap 32. The locking segment can be relatively short in arc length to define a latch or catch or can have an arc length as great or greater than that of the frangible membrane.

In the illustrated embodiment, locking segment 21 is formed integrally with top wall 16 and is spaced radially inwardly from a side wall 14 of the closure 10. Thus, the illustrated embodiment may be formed separately from container 12, for example injection molded, and then inserted into the top end of the container and secured thereto with adhesive, by a friction fit, by welding, or the like. As an alternative to the illustrated configuration, locking segment 21 can be the side wall of the closure which engages the walls of the container to which the closure 10 is mounted. As yet a further alternative, top wall 16 may be secured directly to or formed integrally with container 12. In that case, locking segment 21 could be defined as a part of the side wall of container 12 or could be spaced radially inwardly therefrom and simply depend downwardly from the top wall.

The frangible membrane 18, when intact, hermetically seals the container 12 on which the closure 10 is provided. Below membrane 18 is a flange element 20. Flange element 20 is formed along the length of locking segment 21, which, as noted above may also define the side wall of the closure and/or the container. Snap ridge 20 projects radially inwardly towards the central axis of the closure and the container on which the closure is provided. Thus, flange element 20 is within the container 12.

In accordance with the preferred embodiment, a stop rim 22 is defined on the locking segment 21 below flange element 20. The stop rim 22 also projects radially inwardly into the closed container. In the illustrated embodiment, the stop rim 22 projects further in the radial direction than the flange element 20. The stop rim 22 is also thicker in the axial direction and hence more rigid than the flange element 20.

Figure 6:
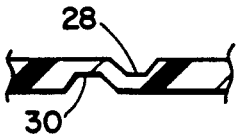
FIG. 6 is an enlarged view of a portion of FIG. 5 but showing an alternate hinge structure in accordance with the present invention.

The hinge 24 is preferably a single groove type living hinge 26 as shown in FIG. 5, but it may be in the form of a double groove type living hinge 28, 30 (FIGS. 6 and 7). When a single groove hinge 26 is provided, it is preferably formed on the exterior surface of top wall 16. As shown, the double groove hinge is formed with one groove 28 in the exterior surface of top wall 16 and the other groove 30 formed in the interior surface of top wall 16.

To open the container closure 12, a pulling force is applied to the gripping tab 34. The frangible membrane 18 is thus broken or torn and the flap 32 is pivoted about living hinge 24 to open the container 12 and provide access to the contents thereof. To reclose the container, the flap 32 is pushed back towards its initial sealed position. The flap 32 is then further pushed below the initial sealed position until the peripheral edge 36 of the flap 32 engages the flange element 20. The pushing force applied to the flap 32 causes the flap to snap over or past the flange element 20 so that the flap is now below the flange element as shown in FIG. 7 to thus reclose the container. The stop rim 22 advantageously limits the downward movement of flap 32. Accordingly, in the reclosed position, the flap 32 will be positioned below the flange element 20 and above the stop rim 22.

To reopen the reclosed container 12, a pulling force is applied to the gripping tab 34. The peripheral edge 36 of the flap 32 is thus snapped over the flange element 20 so the flap 32 is again free to pivot about living hinge to allow access to the container interior.

As is apparent, the closure 10 of the invention initially hermetically seals the container 12 in a manner which makes any tampering with the container closure evident. The frangible membrane 18 maintains the container closed until a positive opening force is applied to the tab 34 of flap 32. Once the closure is opened, membrane 18 will be torn and it will thus be clear that the integrity of the original seal has been compromised. However, the closure can advantageously and easily be reclosed to substantially reseal the container between uses.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

Thus, it is to be understood that variations in the shape and configuration of the closure and its components can be made without departing from the novel aspects of this invention as defined in the claims.

What is claimed is:

1. A container closure comprising:

a top wall including a flap portion having a peripheral edge defined by a straight hinge and a frangible membrane, rupture of said frangible membrane defining a free peripheral edge of said flap portion so that the flap portion can be pivoted about said hinge;

a locking wall portion depending downwardly from said top wall along at least a portion of the length of said frangible membrane on a side thereof opposite to said flap portion; and a flange element projecting from a plane of said locking wall portion toward said flap portion, whereby, following rupture of said frangible membrane, said flap portion can be depressed downwardly by pivoting about said hinge to urge the free peripheral edge of the flap portion past said flange element, said flange element thereafter retaining said flap portion thus depressed until the flap portion is positively pulled upwardly to urge said free peripheral edge past said flange element.

2. A container closure as claimed in claim 1, further comprising a stop rim element projecting from said plane of said locking wall toward said flap portion, said stop rim element being defined below said flange element.

3. A container closure as claimed in claim 1, wherein said flap portion is integrally formed with said top wall and said hinge is a living hinge.

4. A container closure as claimed in claim 3, wherein said living hinge is defined by a single area of reduced thickness in said top wall.

5. A container closure as claimed in claim 3, wherein said living hinge is defined by first and second areas of reduced thickness in said top wall.

6. A container closure as claimed in claim 1, further comprising a gripping tab projecting upwardly from said flap portion.

7. A container closure as claimed in claim 1, in combination with a container having and an open upper end, said closure being mounted to said upper end of said container.

8. A container closure as claimed in claim 1, further comprising a side wall, said side wall being fixed to said top wall.

9. A container closure as claimed in claim 8, wherein said locking wall portion being spaced radially inwardly from said side wall.

10. A container closure as claimed in claim 8, wherein said locking wall portion is defined as a part of said side wall.

11. A container comprising:

at least one side wall defining a product receiving compartment and an open top end;

a top wall closing said top end including a flap portion having a peripheral edge defined by a straight hinge and a frangible membrane, rupture of said frangible membrane defining a free peripheral edge of said flap portion so that the flap portion can be pivoted about said hinge;

a locking wall portion depending downwardly from said top wall along at least a portion of the length of said frangible membrane on a side thereof opposite to said flap portion;

a flange element projecting from a plane of said locking wall portion toward said flap portion;

whereby, following rupture of said frangible membrane, said flap portion can be depressed downwardly by pivoting about said hinge to urge the free peripheral edge of the flap portion past said flange element, said flange element thereafter retaining said flap portion thus depressed until the flap portion is positively pulled upwardly to urge said free peripheral edge past said flange element.

12. A container as claimed in claim 11, further comprising a stop rim element projecting from said plane of said locking wall toward said flap portion, said stop rim element being defined below said flange element.

13. A container as claimed in claim 11, wherein said flap portion is integrally formed with said top wall and said hinge is a living hinge.

14. A container as claimed in claim 13, wherein said living hinge is defined by a single area of reduced thickness in said top wall.

15. A container as claimed in claim 13, wherein said living hinge is defined by first and second areas of reduced thickness in said top wall.

16. A container as claimed in claim 11, further comprising a gripping tab projecting upwardly from said flap portion.

17. A container as claimed in claim 11, wherein said at least one side wall is fixed to said locking wall portion.

18. A container as claimed in claim 11, wherein said locking wall portion is spaced radially inwardly from said at least one side wall.

19. A container as claimed in claim 11, wherein said locking wall portion is defined as a part of said at least one side wall.

* * * * *